US008037638B1

(12) United States Patent
McComb

(10) Patent No.: US 8,037,638 B1
(45) Date of Patent: Oct. 18, 2011

(54) MODULAR PLANTER ASSEMBLY

(76) Inventor: Kathie McComb, West Hills, CA (US)

( * ) Notice: Subject to any disclaimer, the term of this patent is extended or adjusted under 35 U.S.C. 154(b) by 0 days.

(21) Appl. No.: 12/625,621

(22) Filed: Nov. 25, 2009

(51) Int. Cl.
*A01G 5/00* (2006.01)
*A47G 7/00* (2006.01)

(52) U.S. Cl. ..... 47/41.14; 47/65.5; 47/33; 47/66.7; 248/27.8

(58) Field of Classification Search ..... 47/65.5, 47/66.6, 41.14, 32, 32.7, 32.8, 65, 33, 66.7, 47/73, 45, 44; D11/143, 144, 152, 153, 154, D11/155; 248/545, 156, 530, 27.8; 256/65, 256/14, 24, 47
See application file for complete search history.

(56) References Cited

U.S. PATENT DOCUMENTS

| | | | | | |
|---|---|---|---|---|---|
| 54,081 | A | * | 4/1866 | Graham | 530/202 |
| 836,555 | A | * | 11/1906 | Bernie | 220/293 |
| 1,357,732 | A | | 11/1920 | Schimmel | |
| 1,421,327 | A | * | 6/1922 | Waters | 47/41.01 |
| 1,464,801 | A | * | 8/1923 | Beers | 220/493 |
| 1,515,078 | A | * | 11/1924 | Shee | 47/41.01 |
| 1,591,845 | A | * | 7/1926 | Kurtz | 248/146 |
| 1,615,611 | A | * | 1/1927 | Bindon | 47/39 |
| 1,763,130 | A | * | 6/1930 | Cartwright | 248/146 |
| 1,830,769 | A | * | 11/1931 | Rothermel | 248/154 |
| 1,876,322 | A | * | 9/1932 | Rudolph | 248/146 |
| 1,902,423 | A | * | 3/1933 | Seltzer | 47/39 |
| 2,140,862 | A | | 12/1938 | Sumner | |
| 2,430,672 | A | * | 11/1947 | Gandrud | 248/351 |
| 2,509,284 | A | * | 5/1950 | Allen | 248/149 |
| 2,639,878 | A | * | 5/1953 | Pierce | 248/151 |
| 2,774,186 | A | * | 12/1956 | Wilkins | 47/41.01 |
| 2,959,387 | A | * | 11/1960 | Ficek | 248/149 |
| 2,998,952 | A | * | 9/1961 | Williams | 248/156 |
| 3,273,841 | A | * | 9/1966 | Cota | 248/154 |
| D229,575 | S | | 12/1973 | Dallas | |
| 3,896,586 | A | * | 7/1975 | Caldwell | 47/21.1 |
| D304,701 | S | | 11/1989 | Kleinberg | |
| 5,279,072 | A | | 1/1994 | Garbo | |
| 5,649,386 | A | | 7/1997 | Rynberk | |
| 5,683,762 | A | | 11/1997 | Banschick | |
| 6,263,614 | B1 | | 7/2001 | Koo | |
| 6,425,555 | B1 | | 7/2002 | Hedeman | |
| 6,665,980 | B2 | | 12/2003 | Laske, Jr. | |
| 2010/0044530 | A1 | * | 2/2010 | Arcuri | 248/156 |

* cited by examiner

*Primary Examiner* — Andrea Valenti

(57) ABSTRACT

A modular planter assembly for growing plants includes a container with a bottom wall and an outer wall attached to and extending upwardly from the bottom wall. An elongated primary stake is mounted to the outer wall and is engageable with a ground surface. The primary stake is hollow and vertically oriented. An elongated secondary stake is mounted to the outer wall and is engageable with the ground surface. The secondary stake is vertically oriented, and has a size configured to be received by the primary stake.

12 Claims, 7 Drawing Sheets

MODULAR PLANTER ASSEMBLY

BACKGROUND OF THE DISCLOSURE

Field of the Disclosure

The disclosure relates to planter systems and more particularly pertains to a new planter system for growing plants.

SUMMARY OF THE DISCLOSURE

An embodiment of the disclosure meets the needs presented above by generally comprising a modular planter assembly having a container with a bottom wall and an outer wall attached to and extending upwardly from the bottom wall. An elongated primary stake is mounted to the outer wall and is engageable with a ground surface. The primary stake is hollow and vertically oriented. An elongated secondary stake is mounted to the outer wall and is engageable with the ground surface. The secondary stake is vertically oriented, and has a size configured to be received by the primary stake.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
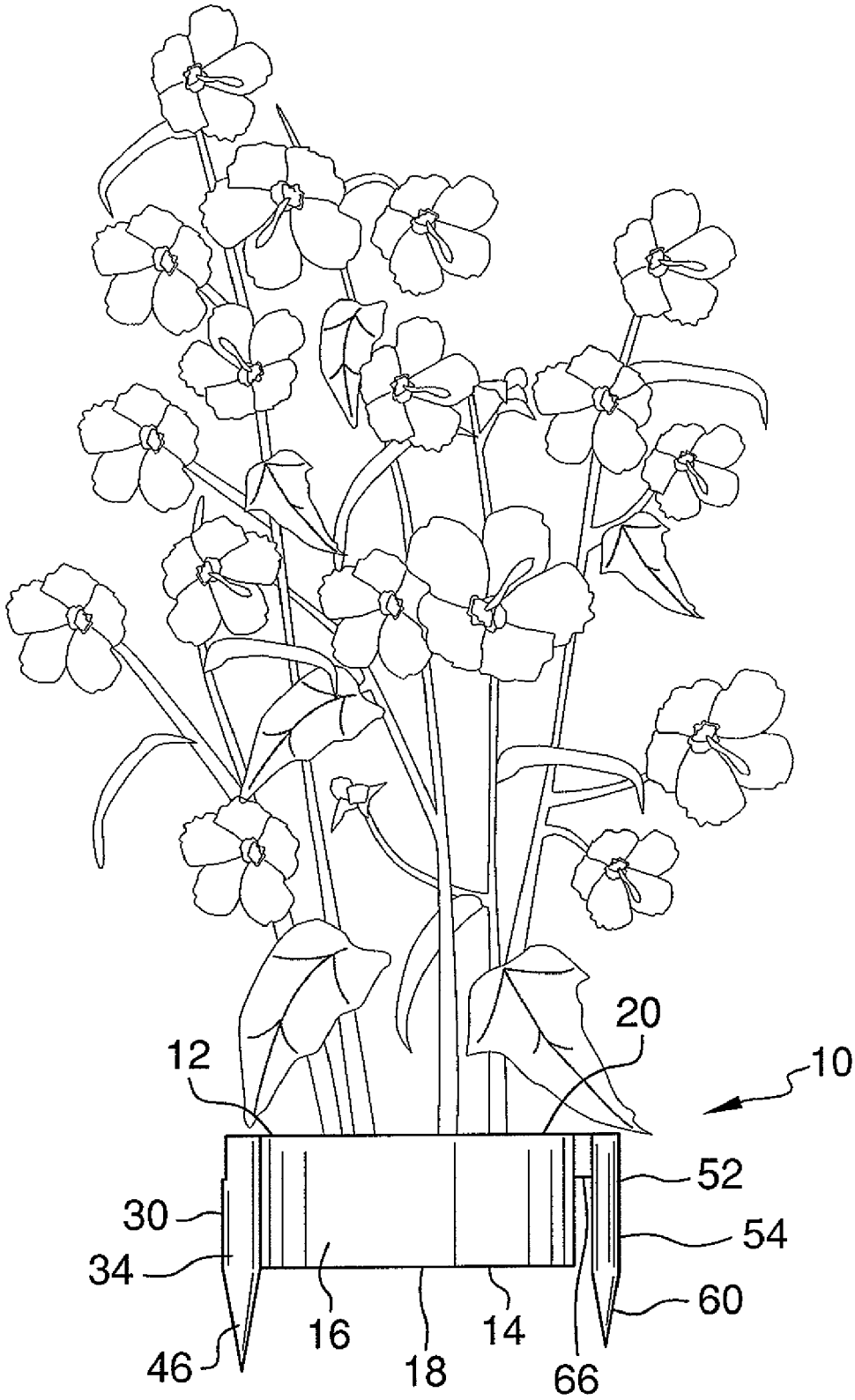
FIG. 1 is a front view of a modular planter assembly according to an embodiment of the disclosure.
Figure 2:
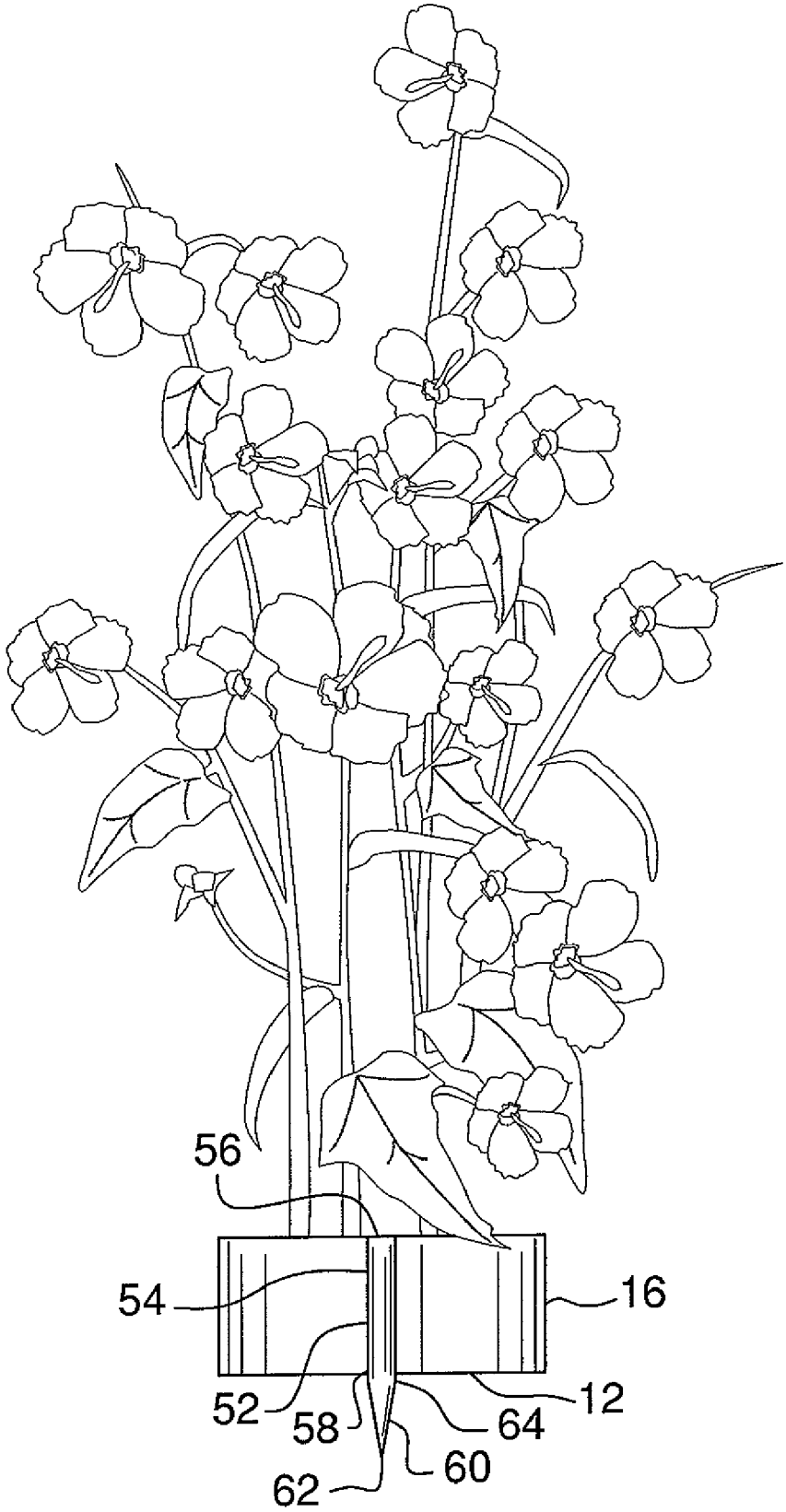
FIG. 2 is a right side view of an embodiment of the disclosure.
Figure 3:
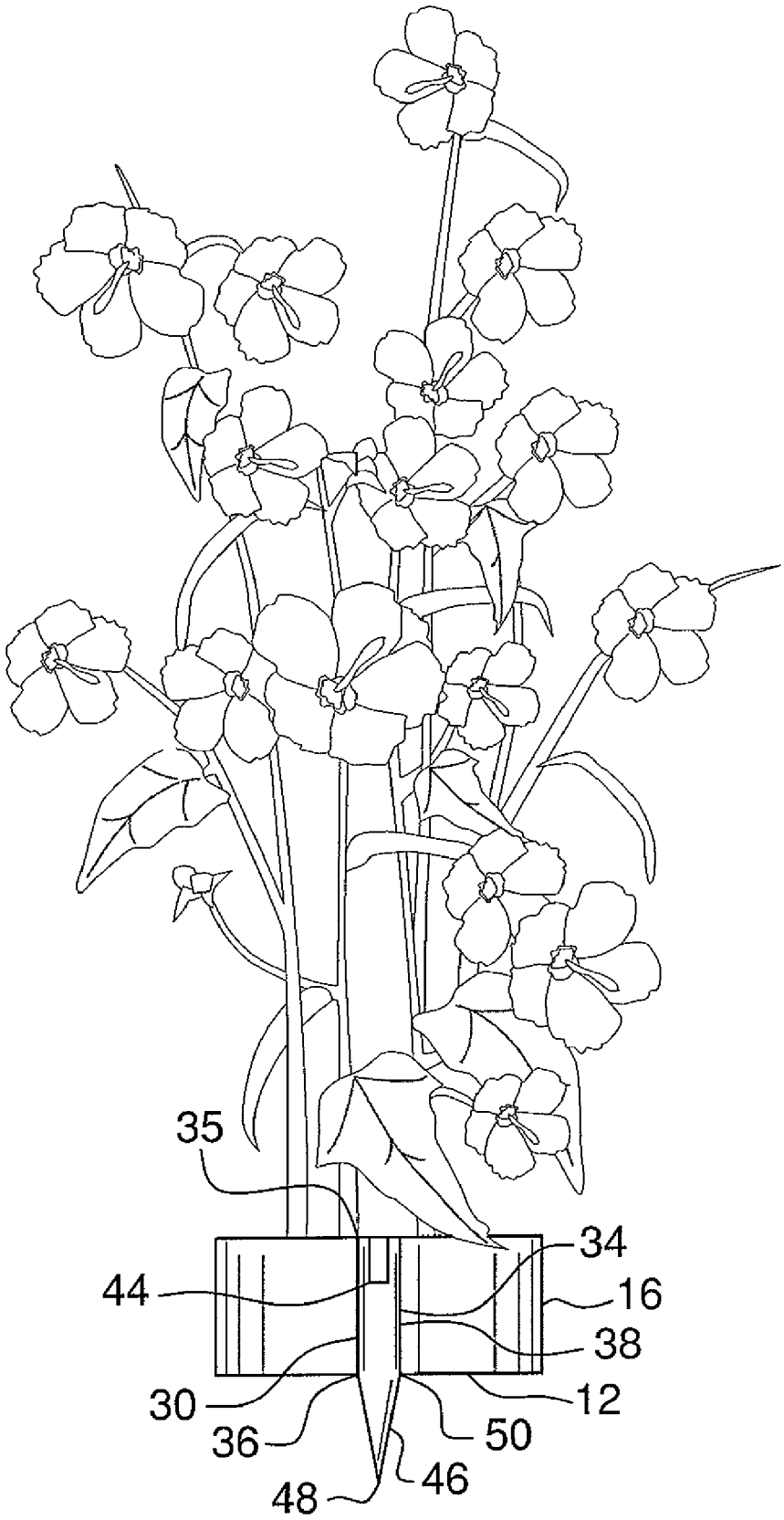
FIG. 3 is a left side view of an embodiment of the disclosure.
Figure 4:
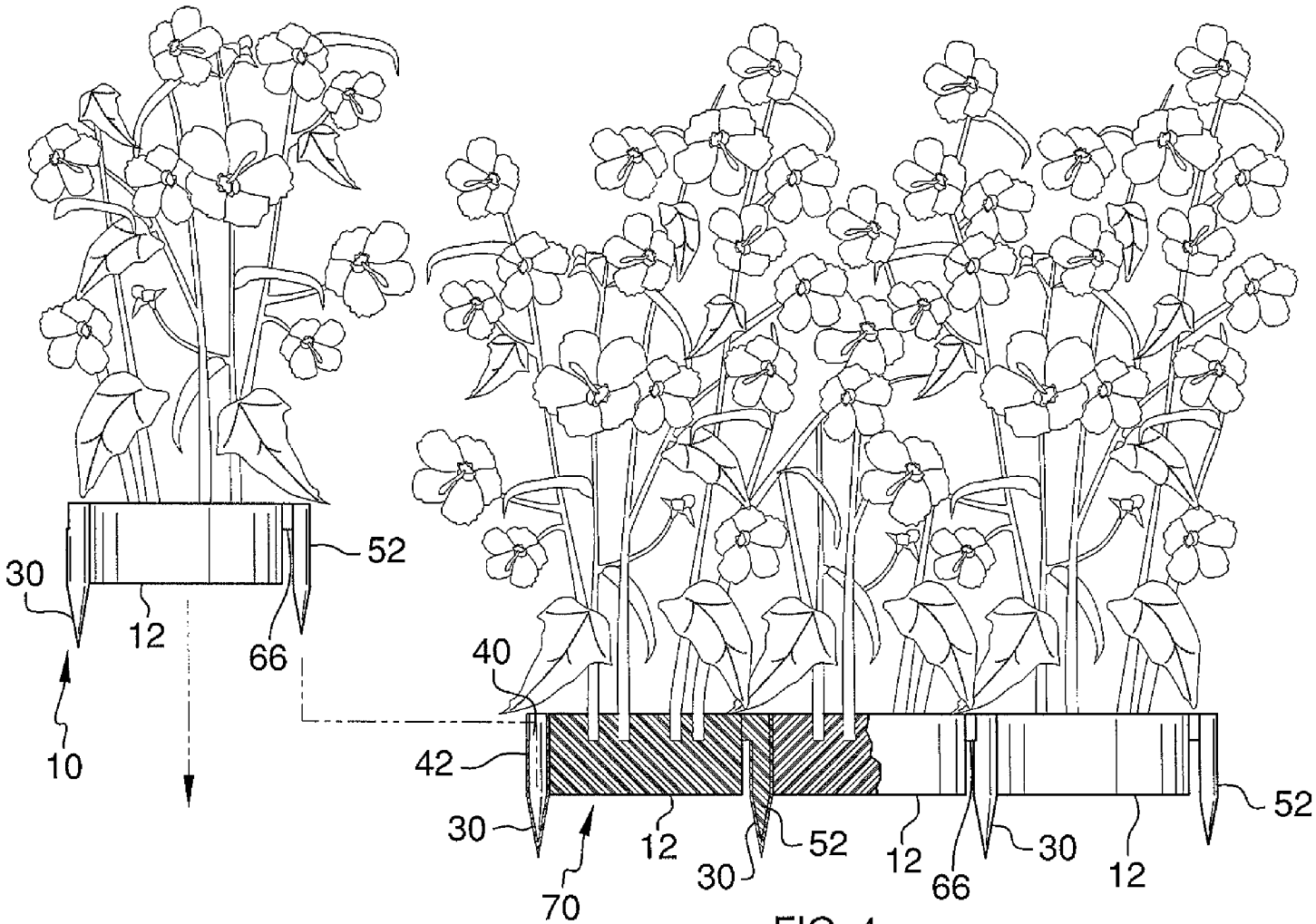
FIG. 4 is a front partial cross-sectional view of an embodiment of the disclosure.
Figure 5:
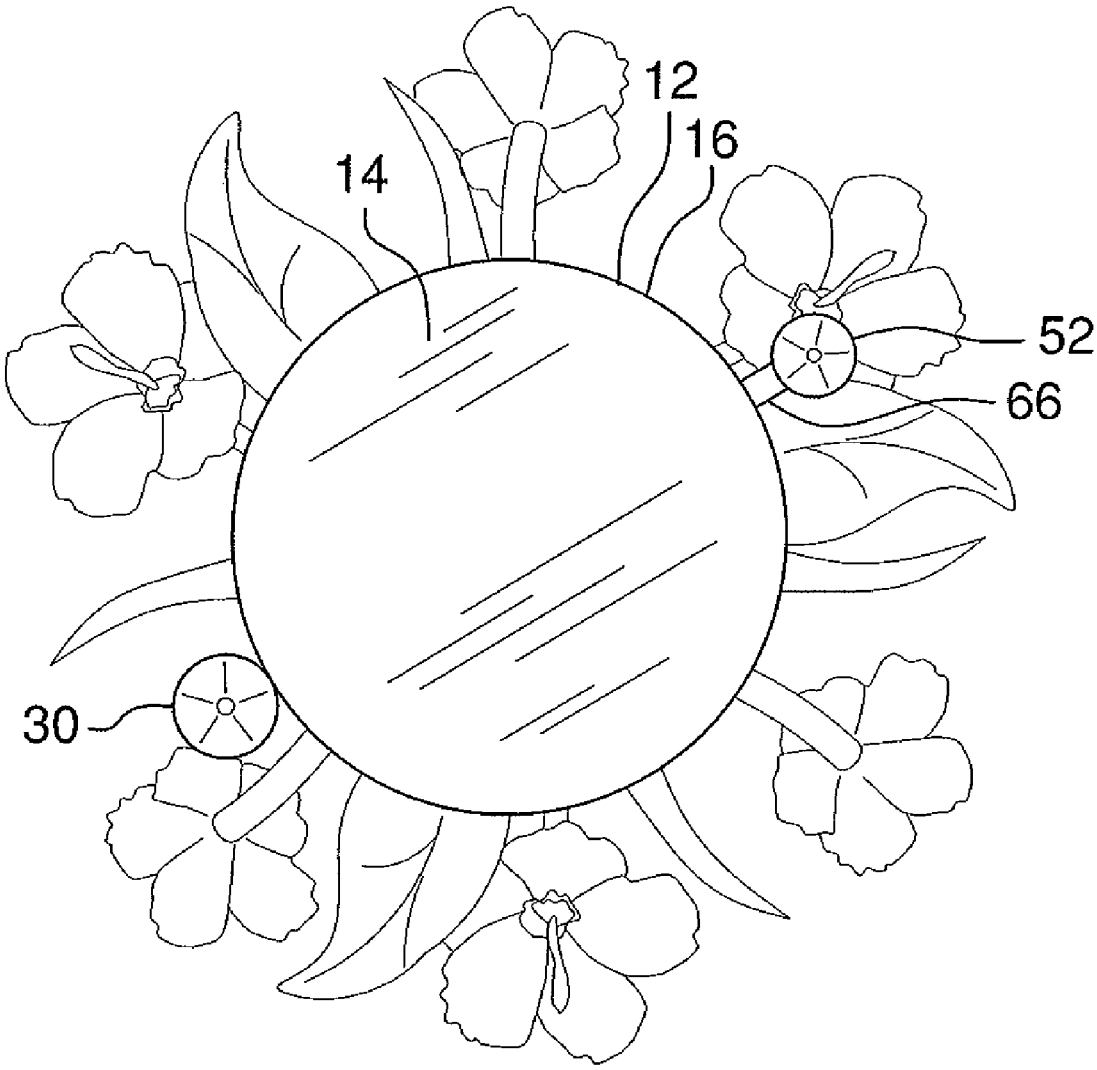
FIG. 5 is a bottom view of an embodiment of the disclosure.
Figure 6:
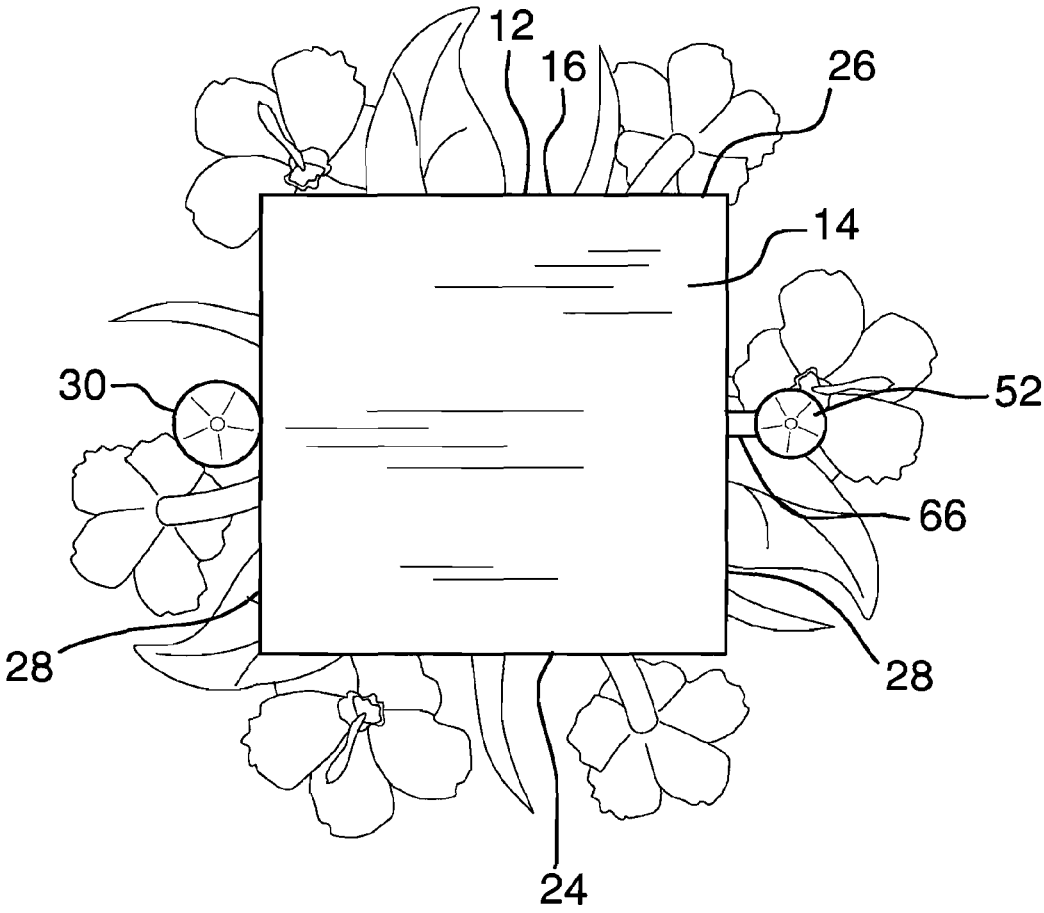
FIG. 6 is a bottom view of an embodiment of the disclosure.
Figure 7:
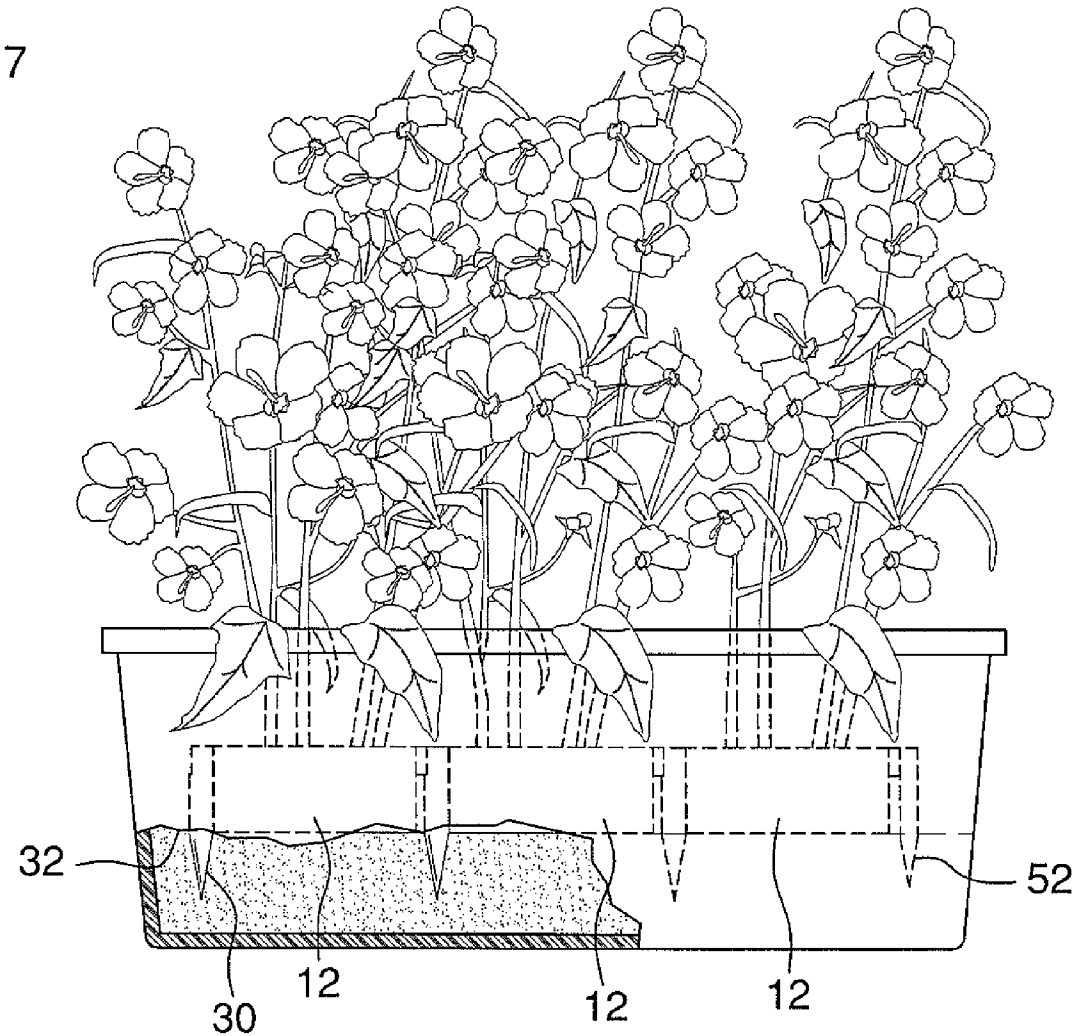
FIG. 7 is a front view of an embodiment of the disclosure.

With reference now to the drawings, and in particular to FIGS. 1 through 7 thereof, a new planter system embodying the principles and concepts of an embodiment of the disclosure and generally designated by the reference numeral 10 will be described.

As best illustrated in FIGS. 1 through 7, the modular planter assembly 10 generally comprises a container 12 having a bottom wall 14 and an outer wall 16 attached to and extending upwardly from the bottom wall 14. The outer wall 16 has a bottom edge 18 that is coextensive with the bottom wall 14. The outer wall 16 has an upper edge 20 that defines an opening 22 into the container 12. For a circular planter, the outer wall 16 may have a circular cross-section. For a box-shaped planter, the outer wall 16 may have a rectangular cross-section. The outer wall 16 can be comprised of a front wall 24, a rear wall 26, and two lateral side walls 28.

An elongated primary stake 30 is mounted to the outer wall 16 and is engageable with a ground surface 32. The primary stake 30 is hollow and vertically oriented. The primary stake 30 is configured to support the container 12 in the ground. The primary stake 30 includes a cylindrical tube 34 having an open top end 35, an open bottom end 36 and a tube wall 38 extending between the open top 35 and bottom 36 ends. The tube wall 38 has an interior surface 40 and an exterior surface 42. The interior surface 40 is spaced apart from the exterior surface 42 by a first distance. The primary stake 30 has a height, an interior diameter equal to the diameter of the interior surface and an exterior diameter equal to the diameter of the exterior surface. The height of the primary stake 30 may range from approximately 3 inches to approximately 10 inches. The interior diameter of the primary stake 30 may range from approximately 0.5 inches to approximately 1.5 inches. The exterior diameter of the primary stake 30 may range from approximately 0.6 inches to approximately 1.5 inches. The tube wall 38 has a slot 44 partially extending into the top end 35 of the tube 34. The slot 44 extends toward the bottom end 36. The top end 35 of the tube 34 is positioned flush with the upper edge 20 of the container 12. A hollow cone 46 having opposite ends is attached to the tube 34. The cone 46 has a point 48 and a base 50. The base 50 is attached to the bottom end 36 of the tube 34 and the point 48 is configured to be extended or inserted into the ground surface 32.

An elongated secondary stake 52 is mounted to the outer wall 16 and is engageable with the ground surface 32. The secondary stake 52 is mounted opposite the primary stake 30 with respect to the container 12. The secondary stake 52 may be mounted at any point on the outer wall 16 where it would be desirable to connect two assemblies 10 together. The secondary stake 52 is vertically oriented and is sized so that the secondary stake 52 can be received by the primary stake 30. The secondary stake 52 is configured to support the container 12 in the ground. The secondary stake 52 includes a cylinder 54 with a top surface 56 and a bottom surface 58. The cylinder 54 has a diameter less than a diameter of the tube 34. The top surface 56 is positioned adjacent to the upper edge 20 of the container 12. A spike 60 having a pointed end 62 and a blunt end 64 is attached to the cylinder 54. The blunt end 64 of the spike 60 is attached to the lower end of the cylinder 54. The spike 60 is configured to be received by the tube 34 of the primary stake 30. The spike 60 is also configured to be received by the cone 46 of the primary stake 30 or to be engaged with the ground surface 32. A spacer 66 is mounted between the cylinder 54 and the outer wall 16, positioned adjacent to the top surface 56 of the cylinder 54. The spacer 66 is elongated along a line orientated parallel to a longitudinal axis of the cylinder 54. The spacer 66 serves to space the cylinder 54 from the outer wall 16 the first distance, so that the secondary stake 52 can be received by the primary stake 30. The spacer 66 is extendable into the slot 44 of the tube 34.

At least a pair of the assemblies 10 are couplable together so that the secondary stake 52 of one of the assemblies is extended into the primary stake 30 of another one of the assemblies.

In use, the primary stake 30 and secondary stake 52 of a first assembly 10 are inserted in the ground to support the first assembly above the ground. A second assembly 10 is coupled to the first assembly by inserting the secondary stake 52 of the second assembly into the primary stake 30 of the first assembly. Downward vertical pressure applied to the second assembly causes the secondary stake 52 of the second assembly to couple to the primary stake 30 of the first assembly, while the primary stake 30 of the second assembly is inserted into the ground. Subsequent assemblies can be coupled in this manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A modular planter assembly comprising:

a container having a bottom wall and an outer wall being attached to and extending upwardly from said bottom wall;

an elongated primary stake mounted to said outer wall and being engageable with a ground surface, said primary stake being hollow, said primary stake being vertically oriented, said primary stake including a cylindrical tube having an open top end, a cone being attached to said bottom end, said cone terminating with a point positioned distal to said open top end; and an elongated secondary stake being mounted to said outer wall and being engageable with the ground surface, said secondary stake being vertically oriented, said secondary stake having a size configured to be received by said primary stake, said secondary stake including a cylinder having a smaller outer diameter than an inner diameter of said tube, a spike being attached to a lower end of said cylinder, said spike and said cylinder being extendable into said tube to allow said assembly to be joined to another one of said assembly, said spike terminating in a point end, each of said point of said primary stake and said pointed end of said elongated secondary stake being positioned below a plane of said bottom wall.

2. The apparatus according to claim 1, wherein at least a pair of said assemblies are couplable together so that said secondary stake of one of said assemblies is extended into said primary stake of another one of said assemblies.

3. The apparatus according to claim 1, wherein said container further comprises said outer wall having a bottom edge being coextensive with said bottom wall, said outer wall having an upper edge defining an opening into said container.

4. The apparatus according to claim 1, wherein said container further comprises said outer wall having a circular cross-section.

5. The apparatus according to claim 1, wherein said container further comprises said bottom wall having a rectangular cross-section.

6. The apparatus according to claim 1, wherein said container further comprises said outer wall comprising a front wall, a rear wall, and two lateral side walls.

7. The apparatus according to claim 1, wherein said primary stake is configured to support said container in ground.

8. The apparatus according to claim 1, wherein said primary stake further comprises:

a cylindrical tube having an open top end, an open bottom end and a tube wall extending between said open top and bottom ends, said tube wall having an interior surface and an exterior surface, said interior surface being spaced apart from said exterior surface by a first distance, said tube wall having a slot therein partially extending into said top end and toward said bottom end, said top end being positioned flush with said upper edge of said container; and a hollow cone being attached to said tube, said cone having opposite ends comprising a point and a base, said base being attached to said bottom end of said tube, said point configured to be extendable into said ground surface.

9. The apparatus according to claim 8, wherein said secondary stake further comprises:

a cylinder having an top surface and a bottom surface, said cylinder having a diameter less than a diameter of said tube, said top surface being positioned adjacent to said upper edge of said container;

a spike being attached to said cylinder and having a pointed end and a blunt end, said blunt end being attached to said lower end of said cylinder, said spike configured to be received by said tube of said primary stake, said spike configured to be received by said cone of said primary stake or to be engaged with the ground surface; and a spacer mounted between said cylinder and said outer wall, said spacer being elongated along a line orientated parallel to a longitudinal axis of said cylinder, said spacer being configured to space said cylinder from said outer wall said first distance, said spacer being extendable into said slot of said tube, said spacer being positioned adjacent to said top surface of said cylinder.

10. The apparatus according to claim 1, wherein said secondary stake is mounted opposite said primary stake with respect to said container.

11. The apparatus according to claim 1, wherein said secondary stake configured to support said container in ground.

12. A modular planter assembly comprising:

a container having a bottom wall and an outer wall being attached to and extending upwardly from said bottom wall, said outer wall having a bottom edge being coextensive with said bottom wall, said outer wall having an upper edge defining an opening into said container;

an elongated primary stake mounted to said outer wall and being engageable with a ground surface said primary stake being hollow, said primary stake being vertically oriented, said primary stake configured to support said container in ground, said primary stake comprising:

a cylindrical tube having an open top end, an open bottom end and a tube wall extending between said open top and bottom ends, said tube wall having an interior surface and an exterior surface, said interior surface being spaced apart from said exterior surface by a first distance, said tube wall having a slot therein partially extending into said top end and toward said bottom end, said top end being positioned flush with said upper edge of said container; and a hollow cone being attached to said tube, said cone having opposite ends comprising a point and a base, said base being attached to said bottom end of said tube, said point configured to be extendable into said ground surface; and an elongated secondary stake being mounted to said outer wall and being engageable with the ground surface, said secondary stake being mounted opposite said primary stake with respect to said container, said secondary stake being vertically oriented, said secondary stake having a size configured to be received by said primary stake, said secondary stake configured to support said container in ground, said secondary stake comprising:

a cylinder having an top surface and a bottom surface, said cylinder having a diameter less than a diameter of said tube, said top surface being positioned adjacent to said upper edge of said container;

a spike being attached to said cylinder and having a pointed end and a blunt end, said blunt end being attached to said lower end of said cylinder, said spike configured to be received by said tube of said primary stake, said spike configured to be received by said cone of said primary stake or to be engaged with the ground surface; and a spacer mounted between said cylinder and said outer wall, said spacer being elongated along a line orientated parallel to a longitudinal axis of said cylinder, said spacer being configured to space said cylinder from said outer wall said first distance, said spacer being extendable into said slot of said tube, said spacer being positioned adjacent to said top surface of said cylinder; and wherein at least a pair of said assemblies are couplable together so that said secondary stake of one of said assemblies is extended into said primary stake of another one of said assemblies.

* * * * *